US007298081B2

(12) United States Patent
Terasaki et al.

(10) Patent No.: US 7,298,081 B2
(45) Date of Patent: Nov. 20, 2007

(54) DISPLAY APPARATUS WITH SHELL-STRUCTURED VACUUM SEAL

(75) Inventors: Takeshi Terasaki, Mito (JP); Atsushi Kazama, Kashiwa (JP); Makoto Kitano, Tsuchiura (JP); Tatsuya Nagata, Ishioka (JP); Takashi Fujimura, Mobara (JP)

(73) Assignee: Hitachi, Ltd., Tokyo (JP)

( * ) Notice: Subject to any disclaimer, the term of this patent is extended or adjusted under 35 U.S.C. 154(b) by 181 days.

(21) Appl. No.: 11/132,295

(22) Filed: May 19, 2005

(65) Prior Publication Data

US 2005/0258735 A1 Nov. 24, 2005

(30) Foreign Application Priority Data

May 21, 2004 (JP) ..... 2004-151339

(51) Int. Cl.
*H01J 1/62* (2006.01)

(52) U.S. Cl. ..... 313/495; 313/496

(58) Field of Classification Search ..... 313/491–497
See application file for complete search history.

(56) References Cited

U.S. PATENT DOCUMENTS 5,223,766 A * 6/1993 Nakayama et al. ..... 313/495
5,964,630 A 10/1999 Slusarczuk et al.

FOREIGN PATENT DOCUMENTS

| | | |
|---|---|---|
| JP | 03-236143 | 10/1991 |
| JP | 2000-100355 | 4/2000 |
| JP | 2000-231892 | 8/2000 |

OTHER PUBLICATIONS

"Basic knowledge of an electronic display for young engineers" In the Apr. 2004 Issue of a technical magazine "Electronic Material" pp. 94 to 102.

* cited by examiner

*Primary Examiner*—Joseph Williams
(74) *Attorney, Agent, or Firm*—Antonelli, Terry, Stout & Kraus, LLP.

(57) ABSTRACT

A display apparatus is disclosed with a vacuum seal member which has a shell structure. The display apparatus includes an anode substrate, a planar cathode substrate forming an electron emitting chamber vacuously sealed between the cathode substrate and the anode substrate, electron sources formed on the cathode substrate, phosphors formed on the anode substrate, and a vacuum seal member forming a pressure balancing chamber on the back of the electron emitting chamber side of the cathode substrate. The vacuum seal member is placed covering the back of the electron emitting chamber side, and has a shell structure for receiving the atmospheric pressure.

3 Claims, 3 Drawing Sheets

DISPLAY APPARATUS WITH SHELL-STRUCTURED VACUUM SEAL

The present application claims priority from Japanese application serial JP 2004-151339 filed on May 21, 2004, the content of which is hereby incorporated by reference into this application.

FIELD OF THE INVENTION

The present invention relates to a display apparatus. Particularly, the present invention is appropriate for a field emission display apparatus.

BACKGROUND OF THE INVENTION

A basic structure of a field emission display apparatus is described in, for example, the special feature "Basic knowledge of an electronic display for young engineers" in the April 2004 issue of a technical magazine "Electronic Material", pages 94 to 102 (non-patent document 1). The field emission display apparatus is so structured that a cathode substrate on which many electron sources for emitting electrons are formed and an anode substrate to which phosphors are applied are placed opposite each other via a gap. Electrons emitted from the electron source corresponding to each pixel impinge on the phosphor to emit light, so that the field emission display apparatus displays images.

In the field emission display apparatus, the gap needs to be secured and vacuously sealed. In many cases, a plurality of thin spacers are set up between the anode substrate and cathode substrate to prevent the gap from collapsing due to the atmospheric pressure. However, the production, placement, and structure of the spacers which are thin enough not to be seen from the outside are difficult. Moreover, charge-up of the spacers causes turbulence of images. Therefore, a display panel structure requiring less or no spacers is desirable. It can be considered that an anode substrate and cathode substrate are made thick to decrease the flexing due to the atmospheric pressure. However, in a large screen panel, a display panel itself becomes very heavy. Patent documents relating to this are as follows.

Japanese Patent Laid-Open No. H3(1991)-236143 (patent document 1) discloses a conventional display apparatus. A vacuum vessel of this display apparatus includes a front plate formed of a transparent glass plate and a back plate formed of metal and having a box shape. Additionally, another back cover formed of metal and having a box shape is provided covering this back plate to make vacuous a space between the back plate and back cover, so that the lightening is achieved.

Japanese Patent Laid-Open No. H7(1995)-296746 (patent document 2) discloses a conventional image display apparatus. This image display apparatus includes a first envelope in which an image display member is disposed and a second envelope which covers the whole of the first envelope. The insides of both envelopes are made vacuous, so that the deformation of the first envelope due to the atmospheric pressure is prevented.

Further, Japanese Patent Laid-Open No. 2000-100355 (patent document 3) discloses a conventional display apparatus. In this display apparatus, a silicon substrate on which electron sources are formed is placed on a plane glass substrate on the electron source side, a glass substrate on the phosphor side is placed opposite the glass substrate on the electron source side, and a metal network is embedded in or attached to the glass substrate on the phosphor side. Accordingly, a strength of the glass substrate on the phosphor side is improved to achieve the thinning and lightening of the glass substrate on the phosphor side.

[Patent document 1] Japanese Patent Laid-Open No. H3(1991)-236143

[Patent document 2] Japanese Patent Laid-Open No. H7(1995)-296746

[Patent document 3] Japanese Patent Laid-Open No. 2000-100355

[Non-patent document 1] Special feature "Basic knowledge of an electronic display for young engineers" in the April 2004 issue of a technical magazine "Electronic Material", pages 94 to 102

SUMMARY OF THE INVENTION

However, in the display apparatus of the patent document 1, the back cover receiving the atmospheric pressure has a box shape similar to the back plate. Accordingly, although the deformation of the back plate can be prevented, the back cover needs to be made thick to withstand the atmospheric pressure. In this point, a problem about the lightening remains.

In the display apparatus of the patent document 2, the second envelope receiving the atmospheric pressure covers the whole of the first envelope. Accordingly, the deformation of the first envelope due to the atmospheric pressure can be prevented, but the second envelope needs to be made thick to withstand the atmospheric pressure. In this point, a problem about the lightening remains.

Further, in the display apparatus of the patent document 3, since the strength of the anode substrate is improved because of the embedding of the metal network, the anode substrate is hardly collapsed. However, a flexural rigidity of the anode substrate is not improved so much. Accordingly, when the anode substrate is made thin, its flexural rigidity is decreased to increase its flexing, so that an appropriate gap between the electron sources and phosphors cannot be maintained. The patent document 1 does not disclose how to thin and lighten the cathode substrate.

An object of the present invention is to provide a display apparatus in which high resolution, thinning, and lightening can be achieved.

To achieve the object, the present invention is a display apparatus including an anode substrate, a cathode substrate placed opposite the anode substrate and forming an electron emitting chamber sealed vacuously between the cathode substrate and the anode substrate, an electron sources formed on the electron emitting chamber side of the cathode substrate, phosphors which are formed on the electron emitting chamber side of the anode substrate in parallel with the electron sources and receive electron beam from the electron sources to emit light, and a shell-structured vacuum seal member which is placed covering the back of the electron emitting chamber side of the cathode substrate, forms a pressure balancing chamber vacuously sealed independent of the electron emitting chamber between the vacuum seal member and the cathode substrate.

A more preferable concrete structure of the present invention is as follows.

(1) The cathode substrate is formed of glass. The vacuum seal member is formed of a metal plate.

(2) The cathode substrate is formed to be a quadrilateral. The vacuum seal member is formed to be a quadrilateral which is almost the same as the shape of the cathode substrate, and portions of at least opposing two sides of the vacuum seal member extend to a bonding area of the cathode substrate for the anode substrate.

According to the present invention, by use of the shell-structured vacuum seal member, the cathode substrate is prevented from deforming. Accordingly, the display apparatus in which high resolution, lightening, and thinning can be achieved can be obtained.

DETAILED DESCRIPTION OF THE PREFERRED EMBODIMENTS

One embodiment of the present invention is explained below with reference to FIGS. 1 to 4.

Figure 1:
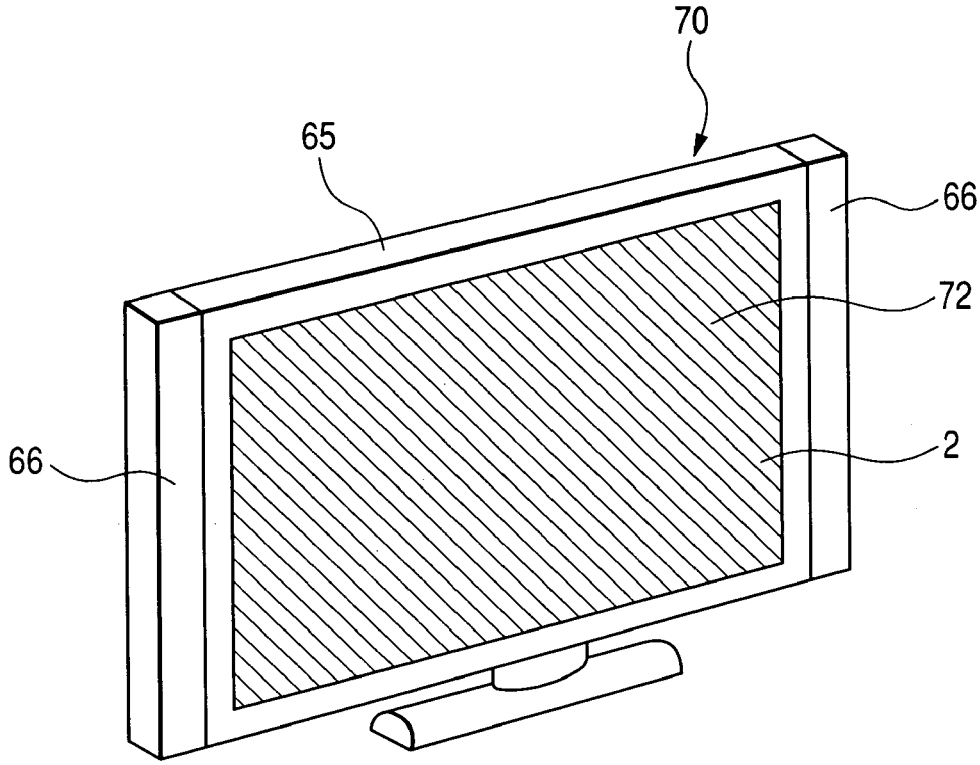
FIG. 1 is an external perspective view of a display apparatus of one embodiment of the present invention.

First, an overall structure of a display apparatus 70 of this embodiment is explained with reference to FIG. 1. FIG. 1 is an external perspective view of the display apparatus 70.

The display apparatus 70 is an example applied to a television set, and includes a body 65, a display panel 72, and speakers 66. The display apparatus of the present invention is applicable to a display apparatus for a personal computer and DVD as well as the television set.

The display panel 72 is thin and light, and mounted in the body 65. An anode substrate 2 of the display panel 72 is exposed from a front window (shaded portion of FIG. 1) in a planar fashion. In this embodiment, the display panel 72 is comprised of a large screen panel of over thirty-two inches. A transparent protection film is applied to a surface of the anode substrate 2 to prevent damage of the anode substrate 2.

The body 65 is formed thin because of the thinning of the display panel 72. A power source, a television tuner, a control portion, and soon are stored in the body 65, and connected to the display panel 72. The speakers 66 are attached to, for example, both sides of the body 65.

Figure 2:
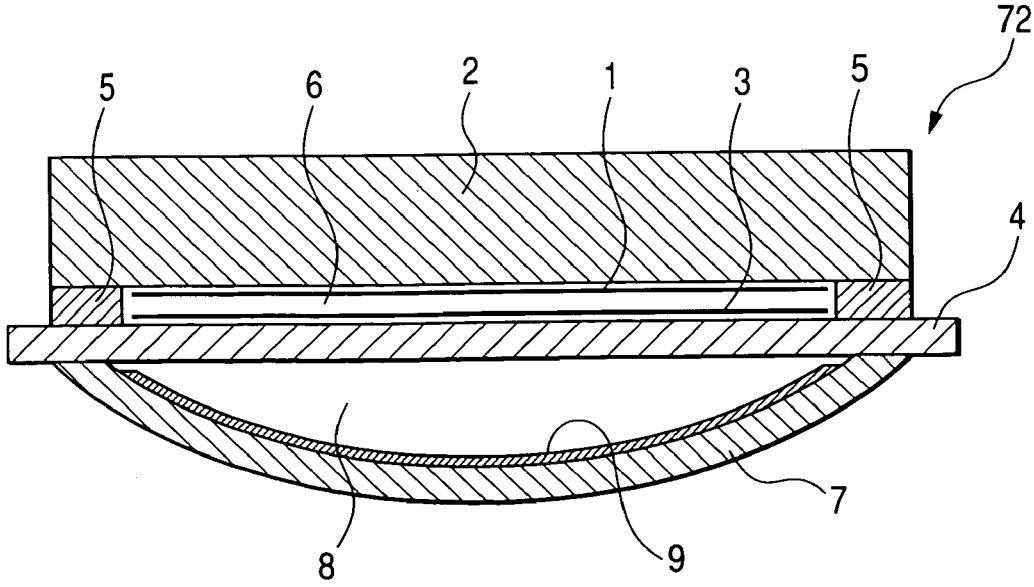
FIG. 2 is a cross sectional view of a display panel of FIG. 1.
Figure 3:
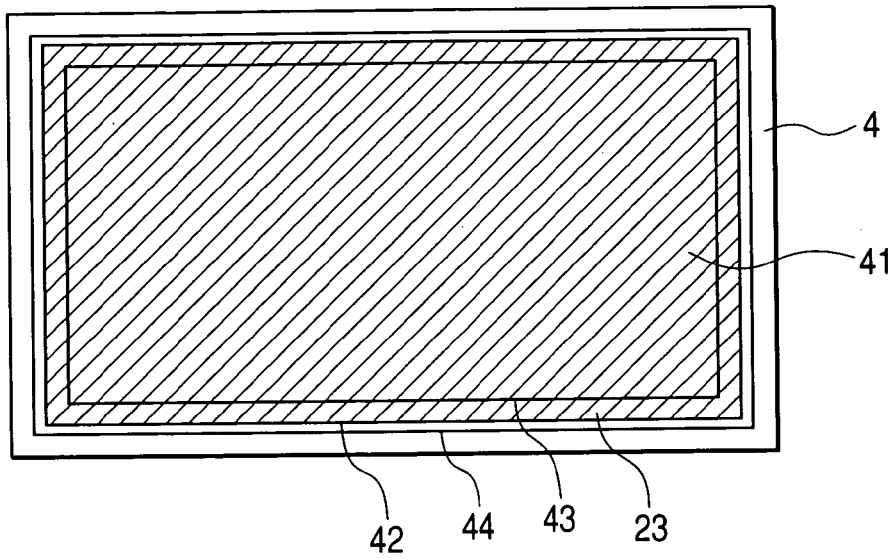
FIG. 3 is a rear view of the display panel of FIG. 2.

Next, the display panel 72 is explained with reference to FIGS. 2 and 3. FIG. 2 is a cross section view of the display panel 72. FIG. 3 is a back view of the display panel 72.

The display panel 72 includes the anode substrate 2 forming an image display surface, a planar cathode substrate 4 which is placed opposite the anode substrate 2 and forms an electron emitting chamber 6 vacuously sealed between the cathode substrate 4 and the anode substrate 2, electron sources 3 formed on the electron emitting chamber side of the cathode substrate 4, phosphors 1 formed on the electron emitting chamber side of the anode substrate 2 and receives electron beam from the electron sources 3 to emit light, a shell-structured vacuum seal member 7 which is formed covering the back of the electron emitting chamber side of the cathode substrate 4, forms a pressure balancing chamber 8 vacuously sealed between the vacuum seal member 7 and the cathode substrate 4. Here the "shell-structure" indicates a structure like a dome exceeding to the side receiving the atmospheric pressure. With such structure, the vacuum seal member 7 has compressive stress and maintains its shape when receiving the atmospheric pressure. As described above, since the vacuum seal member 7 has a light shell structure capable of maintaining its shape against the atmospheric pressure, the display panel 72 can be made lighter compared to the case that the same flexural rigidity as the vacuum seal member 7 is obtained by thickening the substrate 4. A reinforcement rib and so on is formed to the shell-structured vacuum seal member 7, so that further lightening can be achieved.

The anode substrate 2 is formed of a transparent glass whose surface is applied a film of the phosphors 1. The anode substrate 2 is formed to be a quadrilateral (more especially, rectangle). Since the atmospheric pressure is directly applied to a surface of the anode substrate 2, the anode substrate 2 is formed thick not to flex due to the atmospheric pressure.

The cathode substrate 4 has many electron sources 3 on its surface, and is formed in a planar fashion. The cathode substrate 4 has a quadrilateral shape (more especially, a rectangle) rather larger than the anode substrate 2, and is formed thinner than the anode substrate 2. As a material for the cathode substrate 4, glass is used, for example, because of the easiness of a forming process flow of the electron sources 3 and wiring 63 and because of consistency of its thermal expansion coefficient with that of the anode substrate 2. A material for a frame 5 is the same as that of the cathode substrate 4.

The anode substrate 2 and cathode substrate 4 are bonded in parallel with each other via the frame 5 so that the phosphors 1 and electron sources 3 are opposed to each other. The shape of the frame 5 is substantially the same as that of the anode substrate 2. The cathode substrate 4 is formed rather larger than the shape of the frame 5. A space between the anode substrate 2 and cathode substrate 4 is formed as the electron emitting chamber 6 whose periphery is sealed by the frame 5. The electron emitting chamber 6 is evacuated. Electrons emitted from the electron sources 3 impinge upon the phosphors 1, so that the phosphors 1 emits light to display images.

By use of a structure where a periphery of the anode substrate 2 integrally projects as a leg to be bonded to the cathode substrate 4, the frame 5 may be omitted. In this case, for example, the corner of the electron emitting chamber side of the periphery are made circular, so that a tensile stress intensively generated on an outer surface of the anode substrate 2 near the top of the corner is eased. As a result, the structure is hardly collapsed due to evacuation.

Although the placement area for the electron sources is illustrated as one area because of the omission in FIG. 1, many electron sources 3 are actually arranged two-dimensionally. Although the placement area for the phosphors 1 is illustrated as one area because of the omission in FIG. 1, red phosphors, green phosphors, and blue phosphors are actually arranged two-dimensionally corresponding to the electron sources when, for example, a color panel is used.

The pressure balancing chamber 8 is formed between the vacuum seal member 7 and the cathode substrate 4, and vacuously sealed independent of the electron emitting chamber 6. The vacuum seal member 7 is formed of a metal plate. As shown in FIG. 3, the shape of the vacuum seal member 7 is a quadrilateral which is almost the same as that of the cathode substrate 4. All the end portions of four sides of the vacuum seal member 7 extend to a bonding area 23 of the cathode substrate 4 for the anode substrate 2. Since the pressure balancing chamber 8 is formed independently of the electron emitting chamber 6, gas and so on coming into the pressure balancing chamber 8 does not come into the electron emitting chamber 6 through the pressure balancing chamber 8.

In the field emission display panel 72, since the inside of the electron emitting chamber 6 is evacuated, the cathode substrate 4 flexes toward the inside of the electron emitting chamber 6 when the atmospheric pressure is applied to the cathode substrate 4. As a result, an appropriate space between the phosphors 1 and electron sources 3 cannot be maintained. When the cathode substrate 4 is made thick to decrease the flexing, the weight increases in, for example, a large panel of over thirty-two inches, so that its commercial value is decreased.

In this embodiment, since the shape of the vacuum seal member 7 is a quadrilateral which is almost the same as that of the cathode substrate 4, and all the end portions of four sides of the vacuum seal member 7 extend to the bonding area 23 of the cathode substrate 4 for the anode substrate 2, the flexing of the cathode substrate 4 due to the atmospheric pressure can be decreased while the vacuum seal member 7 is light and the cathode substrate 4 is thin. Accordingly, the high resolution, lightening, and thinning can be achieved.

To evacuate the electron emitting chamber 6, at least one evacuation port can be provided to the anode substrate 2, frame 5, or cathode substrate 4. Since the evacuation port cannot be provided to the placement area of the phosphors 1 of the anode substrate 2 and the placement area of the electron sources 3 of the cathode substrate 4 (both areas are on the same picture plane, and hereinafter called an image display area), the evacuation port is placed outside the image display area. To maintain the strength of the peripheries of the anode substrate 2 and frame 5, the evacuation port is preferably provided to the cathode substrate 4. In this case, for example, the vacuum seal member 7 is partially notched on at least one of four corners of the display panel so that the cathode substrate 4 is exposed. Then, an evacuation port 46 can be provided to an area of the notched portion. In this case, an end portion 42 of the vacuum seal member is partially placed inside an inside end portion 43 of the frame bonding area. When most of the four end portions of the reinforcement end portion 42 are placed on the bonding area 23 of the cathode substrate 4 for the anode substrate 2, a problem about the strength does not arise. When at least the opposing two sides of the vacuum seal member 7 are placed on the bonding area 23 of the cathode substrate 4 for the anode substrate 2, a stress does not concentrate near the inside end portion of the frame bonding area of the cathode substrate 4. As a result, the cathode substrate 4 can be prevented from collapsing.

The anode substrate 2 exposes to the outside to show audiences light emission of the phosphors 1. Therefore, it is not preferable that the vacuum seal member 7 is placed on the surface of the anode substrate 2. This embodiment is preferable where the cathode substrate 4, which does not affect on the appearance, is lightened by use of the vacuum seal member 7. As a result, the whole of the display panel can be lightened while maintaining the appearance design.

Figure 4:
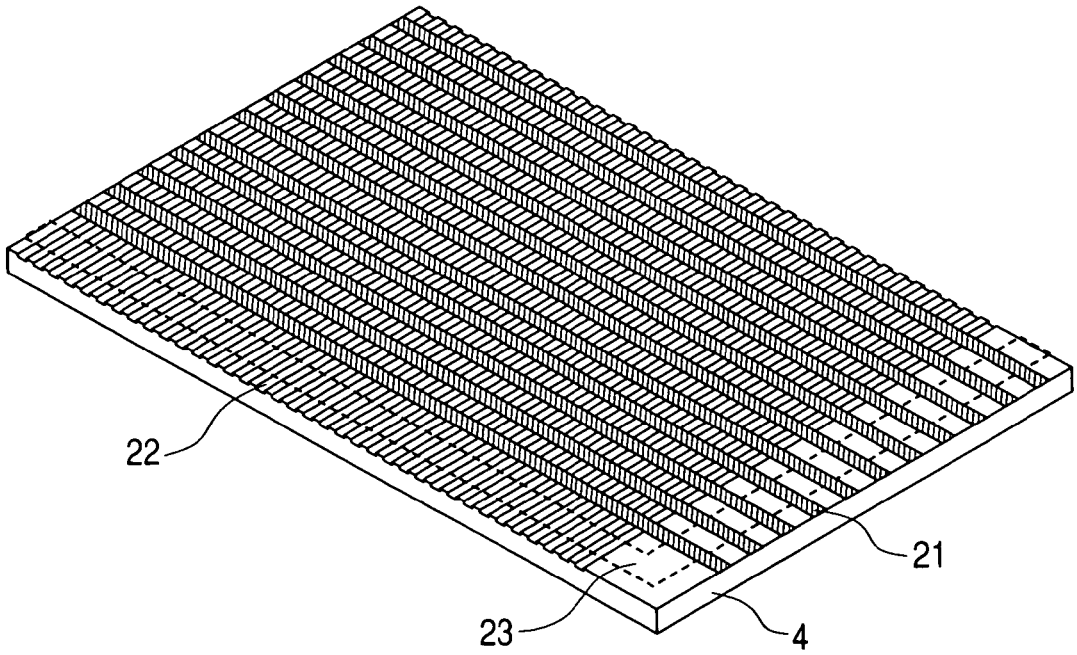
FIG. 4 is a perspective view showing a one quarter portion of a cathode substrate of FIG. 2.
Figure 5A:
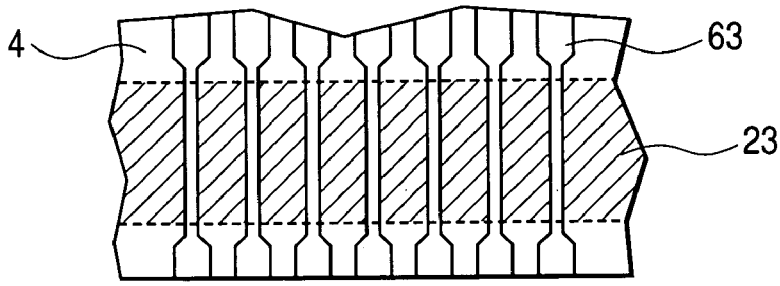
FIGS. 5A to 5C are enlarged plane views of a wiring drawing portion of the cathode substrate of FIG. 2.
Figure 5B:
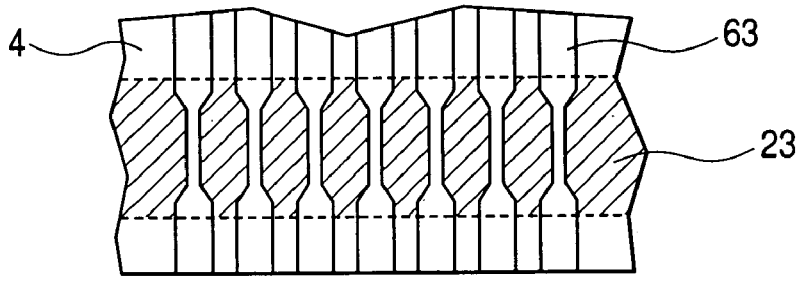
Figure 5C:
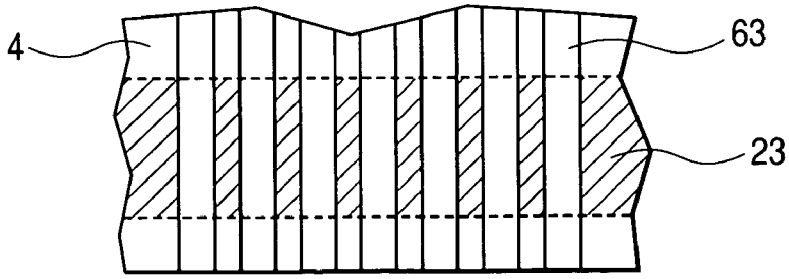

Next, a concrete structure of the cathode substrate 4 is explained with reference to FIGS. 4, 5A, 5B, and 5C. FIG. 4 is a perspective view showing one quarter of the cathode substrate of this embodiment. FIGS. 5A, 5B, and 5C are enlarged plane views showing a wiring drawing portion of FIG. 4.

Many scanning lines 21 and data lines 22 for controlling electrons emitted from the electron sources 3 are formed on the surface (side of the electron emitting chamber 6) of the cathode substrate 4. The scanning lines 21 and data lines 22 need to be drawn to the outside of the electron emitting chamber 6 to be connected to a control device placed outside the display panel 72. The scanning lines 21 and data lines 22 are formed extending to the outside of the substrate bonding area 23, which is shown by dotted lines in FIG. 4 and is a bonding area of the cathode substrate 4 for the anode substrate 2, so that they can be easily drawn although the cathode substrate 4 is bonded to the substrate bonding area 23. When the frame 5 shown in FIG. 2 is used, the substrate bonding area 23 is a bonding area for the cathode substrate 4 and frame 5. When the frame is not used, the substrate bonding area 23 is a bonding area where the cathode substrate 4 and anode substrate 2 are directly bonded to each other.

The frame 5 and cathode substrate 4 are bonded by use of, for example, solder glass. Solder glass in a paste form is applied to the substrate bonding area 23. The frame 5 is aligned with the substrate bonding area 23. Then, by firing the solder glass at about 400° C., the electron sources 3 and cathode substrate 4 can be bonded to each other.

The substrate bonding area 23 includes an area where the wiring 63 is placed (hereinafter called a wiring area) and an area where the surface of the cathode substrate 4 is exposed (hereinafter called a non-wiring area). The wiring 63 collectively means the scanning lines 21 and data lines 22. In the wiring area, adhesive forces between solder glass and the wiring 63 and between the wiring 63 and cathode substrate 4 may be lower than that of the non-wiring area. In this case, the wiring area is made smaller than the non-wiring area to increase the bonding strength of the substrate bonding area 23. The wiring area can be made smaller by thinning the wiring, but the thinning is limited in light of securing a current amount for driving the electron sources 3. As shown in the plane view of FIG. 5A, the wiring 63 is partially thinned in the area including the substrate bonding area 23, so that the wiring area can be made smaller than the wiring area where the wiring has an equal width shown in FIG. 5C, while suppressing the rise of the wiring resistance. When a problem about breakage of the wiring 63 at the end portion of the substrate bonding area 23 arises, the thinner portion of the wiring 63 is placed inside the end portion of the substrate bonding area 23 to secure the width of the wiring at the end portion. As a result, the wiring 63 can be hardly broken. Only the wiring around the end portion may be made wider than the wiring having a normal width.

The number of the scanning lines 21 and data lines 22 is not limited to that shown in FIG. 3. The wiring may be drawn in the directions of all the four sides or three or two sides of the cathode substrate 4. When the wiring is drawn in the three or two directions, the cost for the assembly and wiring can be reduced because the drawn portion is small. On the other hand, when the wiring is drawn in the four directions, an arrangement density can be decreased. As a result, the wiring area for one side becomes small to increase a strength of the bonding portion.

A vacuum inside the electron emitting chamber 6 is preferably a high vacuum of, for example, about $10^{-6}$ Torr so that the electron sources 3 emit electrons stably. On the other hand, a vacuum of the pressure balancing chamber 8 inside the vacuum seal member 7 may be enough not to flex the cathode substrate 4, and does not need to be high in light of shortening the production process. In other words, a vacuum of the electron emitting chamber 6 is preferably higher than a vacuum of the pressure balancing chamber 8. Further, since the cathode substrate 4 receives a pressure corresponding to a pressure difference between the inside of the electron emitting chamber 6 and the inside of the pressure balancing chamber 8, the pressure difference is set so that a rigidity of the cathode substrate 4 itself can resist the pressure difference.

A gettering material 9 is placed inside the pressure balancing chamber 8. Even when gas and so on comes into the pressure balancing chamber 8 through the vacuum seal member 7 or through the bonding portion between the vacuum seal member 7 and cathode substrate 4, the gettering material 9 can absorb the gas. As a result, a vacuum inside the pressure balancing chamber 8 can be maintained for a long time. By forming the gettering material 9 on the whole of the inner surface of the vacuum seal member 7, the gettering material 9 can be formed over a large area.

What is claimed is:

1. A display apparatus comprising:

an anode substrate;

a cathode substrate which is placed opposite the anode substrate end forms an electron emitting chamber vacuously sealed between the cathode substrate and the anode substrate;

electron sources formed on an electron emitting chamber side of the cathode substrate;

phosphors which are formed on an electron emitting chamber side of the anode substrate and receive electron beam from the electron sources to emit light; and a vacuum seal member which has a dome shaped shell structure extending to the side receiving the atmosphere pressure and is placed covering a back of the electron emitting chamber side of the cathode substrate, forms a pressure balancing chamber vacuously sealed independent of the electron emitting chamber between the vacuum seal member and the cathode substrate.

2. The display apparatus according to claim 1, wherein the cathode substrate is formed of glass, and the vacuum seal member is formed of a metal plate.

3. The display apparatus according to claim 1, wherein the cathode substrate is formed to be a quadrilateral, the vacuum seal member is formed to be a quadrilateral which is almost the same as a shape of the cathode substrate, and end portions of at least opposing two sides of the vacuum seal member extend to a bonding area of the cathode substrate for the anode substrate.

* * * * *